US009004036B2

(12) United States Patent
Clarke et al.

(10) Patent No.: US 9,004,036 B2
(45) Date of Patent: Apr. 14, 2015

(54) INTAKE MANIFOLD ASSEMBLY

(71) Applicant: GM Global Technology Operations LLC, Detroit, MI (US)

(72) Inventors: Christopher K. Clarke, Commerce Township, MI (US); John Norman Stockbridge, Waterford, MI (US); Dean G. Sorrell, Rochester Hills, MI (US); Eric F. Grimminger, Rochester Hills, MI (US); Mark J. Wrobel, Birmingham, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/908,274

(22) Filed: Jun. 3, 2013

(65) Prior Publication Data

US 2014/0352643 A1 Dec. 4, 2014

(51) Int. Cl.
*F02M 25/06* (2006.01)
*F02M 35/10* (2006.01)

(52) U.S. Cl.
CPC ... *F02M 35/10144* (2013.01); *F02M 35/10354* (2013.01); *Y10T 29/49231* (2015.01)

(58) Field of Classification Search
USPC ..... 123/184.21–184.61, 568.11–568.32, 123/572–574
See application file for complete search history.

(56) References Cited

U.S. PATENT DOCUMENTS

| | | | | |
|---|---|---|---|---|
| 4,159,703 | A * | 7/1979 | Mayer | 123/452 |
| 4,327,698 | A * | 5/1982 | Hamai et al. | 123/568.17 |
| 4,348,997 | A * | 9/1982 | Takeda et al. | 123/445 |
| 4,811,697 | A * | 3/1989 | Kurahashi | 123/184.35 |
| 5,666,930 | A * | 9/1997 | Elder | 123/568.12 |
| 5,884,612 | A * | 3/1999 | Takeyama et al. | 123/572 |
| 6,609,374 | B2 * | 8/2003 | Feucht et al. | 60/602 |
| 6,928,993 | B2 * | 8/2005 | Yu | 123/568.17 |
| 7,568,340 | B2 * | 8/2009 | Marsal et al. | 60/605.2 |
| 8,267,073 | B2 * | 9/2012 | Kado et al. | 123/572 |
| 2006/0005820 | A1 * | 1/2006 | Jeon | 123/572 |

* cited by examiner

*Primary Examiner* — M. McMahon
(74) *Attorney, Agent, or Firm* — Quinn Law Group, PLLC

(57) ABSTRACT

An intake manifold assembly includes an intake manifold body defining an interior manifold cavity. The intake manifold further includes a throttle mount coupled to the intake manifold body and defining a mount passage in fluid communication with the interior manifold cavity. The throttle mount is configured to be coupled to a throttle assembly. The intake manifold assembly further includes a supplemental gas conduit including a first supplemental gas conduit portion coupled to the intake manifold body. The supplemental gas conduit further includes a second supplemental gas conduit portion in fluid communication with the first supplemental gas conduit portion. The second supplemental gas conduit portion is coupled to the throttle mount and is configured to deliver supplemental gases into the mount passage to mix the supplemental gases with intake air flowing through the mount passage.

19 Claims, 4 Drawing Sheets

INTAKE MANIFOLD ASSEMBLY

TECHNICAL FIELD

The present disclosure relates to intake manifold assemblies of an internal combustion engine.

BACKGROUND

Internal combustion engines typically include an intake manifold assembly to provide intake air to an intake port for subsequent introduction to a combustion chamber, where it is combusted with an amount of fuel. The intake manifold assembly typically includes a plenum and at least one intake runner in communication with the plenum and intake port.

SUMMARY

An intake manifold assembly includes an intake manifold body defining an interior manifold cavity. The intake manifold further includes a throttle mount coupled to the intake manifold body and defining a mount passage in fluid communication with the interior manifold cavity. The throttle mount is configured to be coupled to a throttle assembly. The intake manifold assembly further includes a supplemental gas conduit including a first supplemental gas conduit portion coupled to the intake manifold body. The first supplemental gas conduit portion is configured to be coupled to a supplemental gas source. The supplemental gas conduit further includes a second supplemental gas conduit portion in fluid communication with the first supplemental gas conduit portion. The second supplemental gas conduit portion is coupled to the throttle mount and is configured to deliver supplemental gas into the mount passage to mix the supplemental gas with intake air flowing through the mount passage.

In an embodiment, the supplemental gas conduit includes a third supplemental gas conduit portion in fluid communication with the second fluid conduit, the third supplemental gas conduit portion being in fluid communication with the mount passage. The throttle mount defines at least one supplemental gas opening disposed in fluid communication with the third supplemental gas conduit portion. The one supplemental gas opening is configured to allow supplemental gas to flow from the third supplemental conduit opening into the mount passage. The third supplemental gas conduit portion has a substantially annular shape. The third supplemental gas conduit portion is disposed within the throttle mount and around the mount passage. The third supplemental gas conduit portion may be monolithically formed with the throttle mount. The first supplemental gas conduit portion may be monolithically formed with the intake manifold body. The first supplemental gas conduit portion is not in direct fluid communication with the interior manifold cavity. The second supplemental gas conduit portion may be monolithically formed with the throttle mount. The intake manifold assembly may further include a seal assembly coupled to the throttle mount. The seal assembly partially defines the third supplemental gas conduit portion.

The present disclosure also relates to a supplemental gas distribution device. In an embodiment, the supplemental gas distribution device includes a device body configured to be coupled between an intake manifold body and a throttle assembly. The device body defines a device passage. The device extension protrudes from the device body in a direction away from the device passage. The supplemental gas distribution device further includes a port supported by the device extension. The port is configured to be fluidly coupled to a supplemental gas source. The supplemental gas distribution device further includes a seal coupled to the device body and surrounding the device passage. The device body and the device extension jointly define a supplemental gas track in fluid communication with the port. The supplemental gas track is disposed within the device body and the device extension. The supplemental gas track is in fluid communication with the device passage so as to transfer supplemental gases from the port to the device passage to mix the supplemental gases with intake air flowing through the device passage.

In an embodiment, the device body defines a plurality of device openings disposed around the device passage. Each of the device openings is configured to fluidly couple the device passage to the supplemental gas track. The port may be a first port, and the device extension may be a first device extension. The supplemental gas distribution device may further include a second device extension protruding from the device body, and a second port supported by the first device extension. The second port is configured to be fluidly coupled to a vacuum servo. The second device extension and the device body fluid jointly define a vacuum channel disposed in fluid communication with the second port. The vacuum channel may be entirely disposed within the second device extension and the device body. The device body defines at least one device opening configured to fluidly couple the device passage with the vacuum channel. The device body may have a substantially annular shape. The device passage is surrounded by the device body. The device body may have a substantially planar configuration.

The present disclosure also relates to methods of manufacturing an internal combustion engine. In an embodiment, the method includes coupling a supplemental gas distribution device to an intake manifold assembly. The intake manifold assembly includes an intake manifold body. The supplemental gas distribution device includes a device body. The supplemental gas distribution device defines a device passage disposed in fluid communication with the intake manifold body when the supplemental gas distribution device is coupled to the intake manifold assembly. The supplemental gas distribution device further defines a supplemental gas track at least partly disposed in the device body. The supplemental gas track is in fluid communication with the device passage. The method further includes fluidly coupling the supplemental gas track to a supplemental gas source. In addition, the method further includes coupling a throttle assembly to the supplemental gas distribution device and the intake manifold assembly such that the supplemental distribution device is disposed between the intake manifold assembly and the throttle assembly in order to deliver supplemental gases to a location between the throttle assembly and the intake manifold body.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Figure 1:
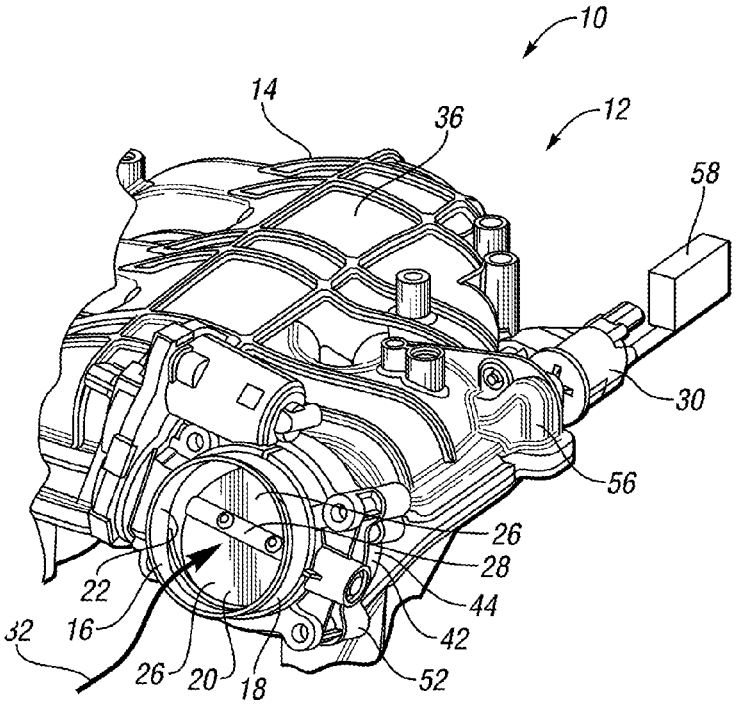
FIG. 1 is a schematic perspective view of a portion of a vehicle including an intake manifold assembly, a throttle assembly coupled to the intake manifold assembly, and a supplemental gas valve coupled to the intake manifold assembly.
Figure 2:
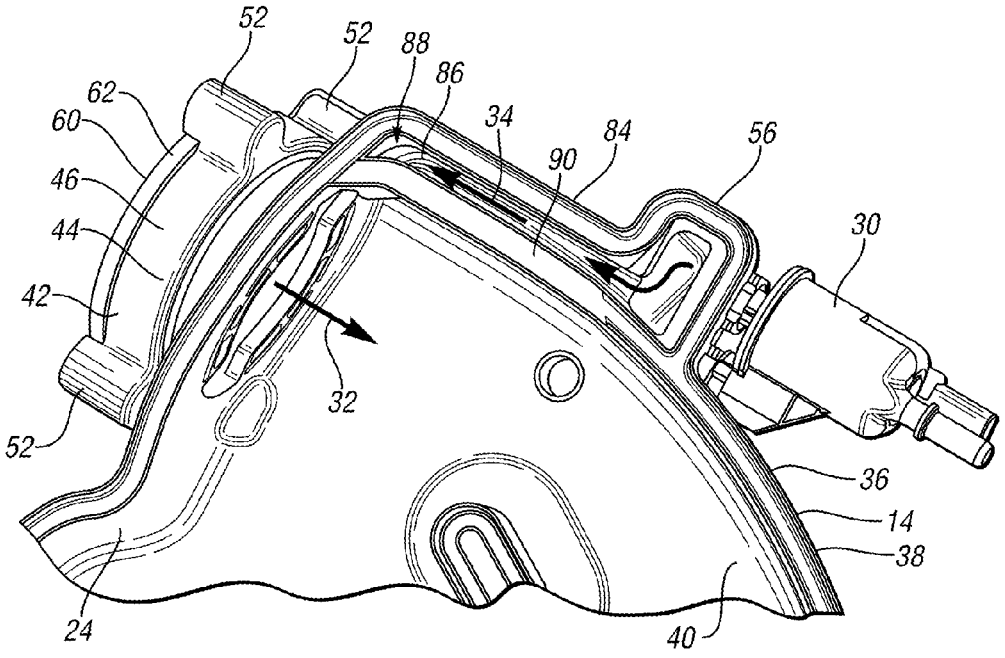
FIG. 2 is a schematic cutaway view of a portion of the intake manifold assembly and the supplemental gas valve shown in FIG. 1.
Figure 3:
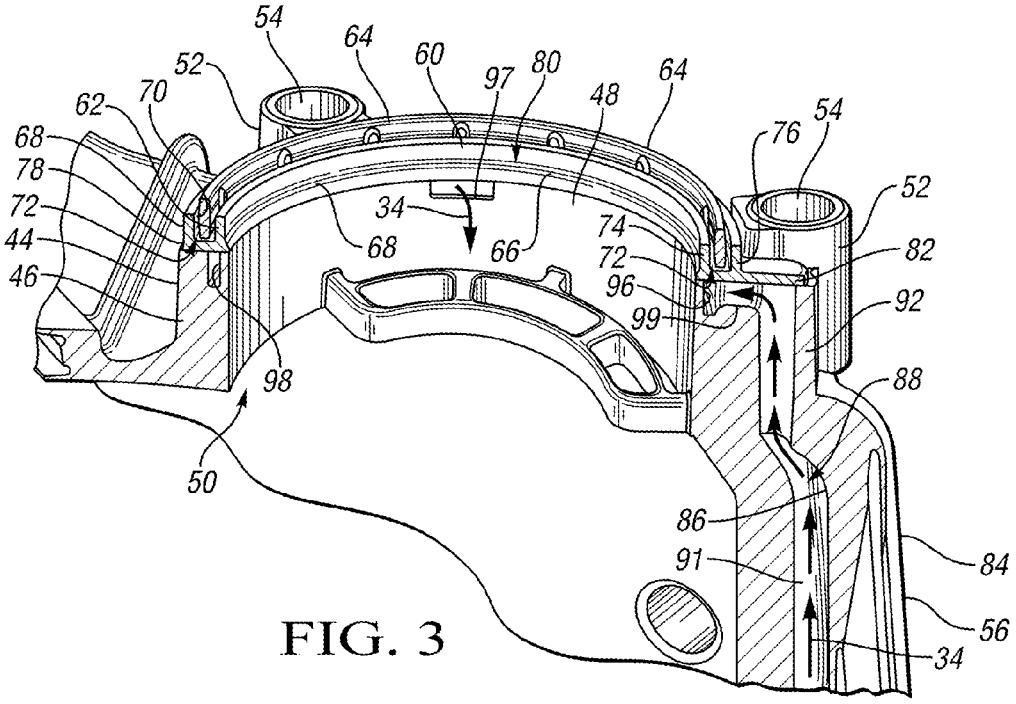
FIG. 3 is an enlarged schematic cross-sectional perspective view of a portion of the intake manifold assembly.

Referring to FIGS. 1-3, a vehicle 10, such as a car, includes an internal combustion engine 12 configured to power a transmission (not shown). The internal combustion engine 12 may be a compression ignited or spark ignited type internal combustion engine and includes an intake manifold assembly 14 configured to deliver intake air 32 to the cylinders (not shown) of the internal combustion engine 12. The internal combustion engine 12 further includes a throttle assembly 16 configured to regulate the amount of intake air 32 that flows into the intake manifold assembly 14.

The intake manifold assembly 14 is wholly or partly made of a substantially rigid material, such as a metallic material, and includes a manifold body 36. The manifold body 36 defines an outer body surface 38 and an inner body surface 40 opposite the outer body surface 38. The inner body surface 40 defines an interior manifold cavity 24. Moreover, the intake manifold assembly 14 includes a throttle mount 42 configured to facilitate coupling the throttle assembly 16 to the manifold body 36. The throttle mount 42 includes a mount body 44 defining an outer mount surface 46 and an inner mount surface 48 (FIG. 3) opposite the outer mount surface 46. The inner mount surface 48 defines a mount passage 50 (FIG. 3) disposed in fluid communication with the interior manifold cavity 24. The mount body 44 as well as the mount passage 50 may be substantially cylindrical. The throttle mount 42 further includes one or more mount protrusions 52 extending outwardly (i.e. in a direction away from the mount passage 50) from the mount body 44. Each mount protrusion 52 may define a mount opening 54 configured, shaped, and sized to receive a suitable fastener, such as a bolt, configured to couple the throttle assembly 16 to the throttle mount 42.

The throttle assembly 16 is wholly or partly made of a substantially rigid material, such as a metallic material, and includes a throttle body 18 and a throttle valve 20 movably coupled to the throttle body 18. The throttle body 18 may be substantially hollow and may define a throttle passage 22 that is in fluid communication with an interior manifold cavity 24 (FIG. 2). In the depicted embodiment, the throttle body 18 has a substantially cylindrical shape. It is nonetheless envisioned that the throttle body 18 may have any suitable shape. The throttle valve 20 may be movably coupled to the throttle body 18 within the throttle passage 22. In the depicted embodiment, the throttle valve 20 is a butterfly valve and includes a throttle plate 26 and throttle shaft 28 rotationally coupled to the throttle body 18 within the throttle passage 22. The throttle plate 26 is coupled to the throttle shaft 28. As such, the throttle plate 26 is configured to pivot with respect to the throttle body 18 between an open position and a closed position to control the amount of intake air that flows into the interior manifold cavity 24 (FIG. 2) of the intake manifold assembly 14.

The internal combustion engine 12 further includes a seal assembly 60 coupled between the throttle assembly 16 and the throttle mount 42 of the intake manifold assembly 14. The seal assembly 60 is configured to prevent a fluid leak and may have a substantially annular shape. As such, the seal assembly 60 defines a seal passage 80 substantially aligned with the mount passage 50 and the throttle passage 22. In the depicted embodiment, the seal assembly 60 includes a seal mount 62 made of a substantially rigid material, such as a hard polymeric material, and a seal 64 made of an impermeable material such as an impermeable polymeric material.

The seal mount 62 may have a substantially annular shape and includes a seal mount body 66. The seal mount body 66 includes a first seal mount wall 74, a second seal mount wall 76, and an third seal mount wall 78 interconnecting the first seal mount wall 74 and the second seal mount wall 76. The first seal mount wall 74 defines the outer perimeter of the seal assembly 60, whereas the second seal mount wall 76 defines the seal passage 80. Further, the seal mount body 66 defines an outer seal mount surface 68 and an interior seal mount surface 70. In particular, the first seal mount wall 74, the second seal mount wall 76, and the third seal mount wall 78 collectively define the interior seal mount surface 70. The interior seal mount surface 70 defines a track 72, which may have a substantially annular shape. Specifically, the third seal mount wall 78 separates the first seal mount wall 74 from the second seal mount wall 76 so as to define the track 72. Thus, the track 72 is disposed between the first seal mount wall 74 and the second seal mount wall 76. Moreover, the track 72 is configured, shaped, and sized to tightly receive the seal 64. The seal 64 may have a substantially annular shape and may be configured as an O-ring. In addition to the seal 64, the seal assembly 60 includes a seal mount extension 82 extending from the seal mount in a direction away from the seal passage 80. Specifically, the seal mount 82 extends from third seal mount wall 78 in a direction away from the seal passage 80. The seal mount extension 82 and the third seal mount wall 78 are coupled to the throttle mount 42. For example, the seal mount extension 82 and the third seal mount wall 78 may be welded to the throttle mount 42.

The internal combustion engine 12 further includes a supplemental gas valve 30 fluidly coupling the intake manifold assembly 14 to one or more supplemental gas source 58 of the vehicle 10 such as a purge gas source, an engine crankcase, an exhaust gas recirculation (EGR) system or a charcoal canister. As such, supplemental gases 34 stemming from one or more supplemental gas source 58 can be mixed with the intake air 32 flowing into the intake manifold assembly 14. The supplemental gases 34 may be non-combustible gases, combustible gases, or a combination thereof. For instance, the supplemental gases may be EGR gases, engine crankcase vent gases, natural gas, propane, any other fuel, among others. It is desirable to mix the intake air 32 flowing into the intake manifold assembly 14 with supplemental gases to improve fuel efficiency. The supplemental gases 34, however, should be distributed uniformly throughout the cylinders of the internal combustion engine 12 to minimize a cylinder-to-cylinder imbalance. The cylinder-to-cylinder imbalance is usually reflected in air-fuel ratio (AFR) cylinder imbalance and volumetric efficiency cylinder imbalance. AFR cylinder imbalance refers to the situation in which all the cylinders do not have substantially similar AFRs, and volumetric efficiency cylinder imbalance refers to the situation in which all the cylinders do not have substantially similar volumetric efficiencies. To maximize fuel efficiency and power, it is desirable to develop an intake manifold assembly capable of distributing the supplemental gases 34 uniformly throughout the cylinders of the internal combustion engine 12 to minimize cylinder-to-cylinder imbalance.

To minimize the cylinder-to-cylinder imbalance, the intake manifold assembly 14 includes a supplemental gas conduit 56 configured, shaped, and sized to deliver supplemental gases 34 originating from the supplemental gas source 58, via the supplemental gas valve 30, to the mount passage 50. Specifically, the supplemental gas conduit 56 fluidly couples the supplemental gas valve 30 to the mount passage 50. That way, the supplemental gases 34 are mixed with the intake air 32 at the mount passage 50 before entering the interior manifold cavity 24. Hence, the supplemental gases 34 are evenly mixed with the intake air 32 before entering the cylinders of the internal combustion engine 12, thereby minimizing cylinder-to-cylinder imbalance.

At least a portion of the supplemental gas conduit 56 is coupled to the intake manifold body 36. For example, at least a portion of the supplemental gas conduit 56 can be coupled to the intake manifold body 36 via any suitable means such as welding, bolting, molding and adhesives. The supplemental gas conduit 56 may alternatively be monolithically formed with the intake manifold body 36. Moreover, the supplemental gas conduit 56 is not in direct fluid communication with the interior manifold cavity 24. Rather, the supplemental gas conduit 56 is in direct fluid communication with the mount passage 50 as discussed in detail below.

In the depicted embodiment, the supplemental gas conduit 56 defines an outer supplemental conduit surface 84 and an inner supplemental conduit surface 86. The inner supplemental surface 86 defines a supplemental gas passage 88, which may also be referred to as a supplemental track. The supplemental gas conduit 56 further includes a supplemental gas wall 90, which may be part of the intake manifold body 36. The supplemental gas wall 90 separates the supplemental gas passage 88 from the interior manifold cavity 24. As such, the supplemental gas passage 88 is not in direct fluid communication with the interior manifold cavity 24. It is nonetheless contemplated that the supplemental gas passage 88 may be in direct fluid communication with the interior manifold cavity 24.

In the depicted embodiment, the supplemental gas conduit 56 includes a first supplemental gas conduit portion 91 and a second supplemental gas conduit portion 92. The first supplemental gas conduit portion 91 and the second supplemental gas conduit portion 92 are in fluid communication with each other. However, the first supplemental gas conduit portion 91 is coupled to, or monolithically formed with, the intake manifold body 36, whereas the second supplemental gas conduit portion 92 is coupled to, or monolithically formed with, the mount body 44.

The supplemental gas conduit 56 further includes a third supplemental gas conduit portion 96 disposed in fluid communication with the second supplemental gas conduit portion 92. The third supplemental gas conduit portion 96 may define a supplemental channel 98 wholly or partly disposed within the mount body 44. For example, the supplemental channel 98 may be entirely disposed between the outer mount surface 46 and an inner mount surface 48 of the mount body 44. The supplemental channel 98 may have a substantially annular shape and may be circumscribed by the third seal mount wall 78, an interior mount surface 99 defined by the mount body 44, and the seal mount extension 82 of the seal mount 62. The seal mount 62 therefore partially defines the supplemental channel 98. In other words, the seal assembly 60 partially defines the third supplemental gas conduit portion 96. The third supplemental gas conduit portion 96 may have a substantially annular shape and may be disposed within the throttle mount 42. Further, the third supplemental gas conduit portion 96 is disposed around the mount passage 50. The third supplemental gas conduit portion 96 may be monolithically formed with the throttle mount 42.

The supplemental gas conduit 56 includes one or more supplemental gas openings 97 fluidly coupling the supplemental channel 98 and the mount passage 50. The mount body 44 and a portion of the seal assembly 60, such as the seal mount body 66, jointly define each supplemental gas openings 97. In particular, the supplemental gas openings 97 extend through the inner mount surface 48 and may be annularly spaced apart from one another. Thus, a plurality of supplemental gas openings 97 may be disposed along the inner mount surface 48.

During operation of the internal combustion engine 12, the supplemental gases 34 may be introduced into the intake manifold assembly 14 to improve fuel economy. To do so, the supplemental gases 34 flow from the supplemental gas source 58 to the supplemental gas conduit 56 via the supplemental gas valve 30. As discussed above, the supplemental gas valve 30 can regulate the flow of supplemental gases 34 into the supplemental gas conduit 56. Once in the supplemental gas conduit 56, the supplemental gases 34 flow from the first supplemental gas conduit portion 91 to the second supplemental gas conduit portion 92. Subsequently, the supplemental gases 34 flow from the second supplemental gas conduit portion 92 to the supplemental channel 98 disposed within the mount body 44. The supplemental gases 34 then exit the supplemental channel 98 via the supplemental gas openings 97, thereby entering the mount passage 50. Consequently, the supplemental gas conduit 56 allows supplemental gases 34 originating from the supplemental gas source 58 to travel from the supplemental gas source 58 into the mount passage 50, which is located between the throttle assembly 16 and the intake manifold body 36. At this point, the supplemental gases 34 can mix with the intake air 32 entering the mount passage 50 via the throttle assembly 16.

Figure 4:
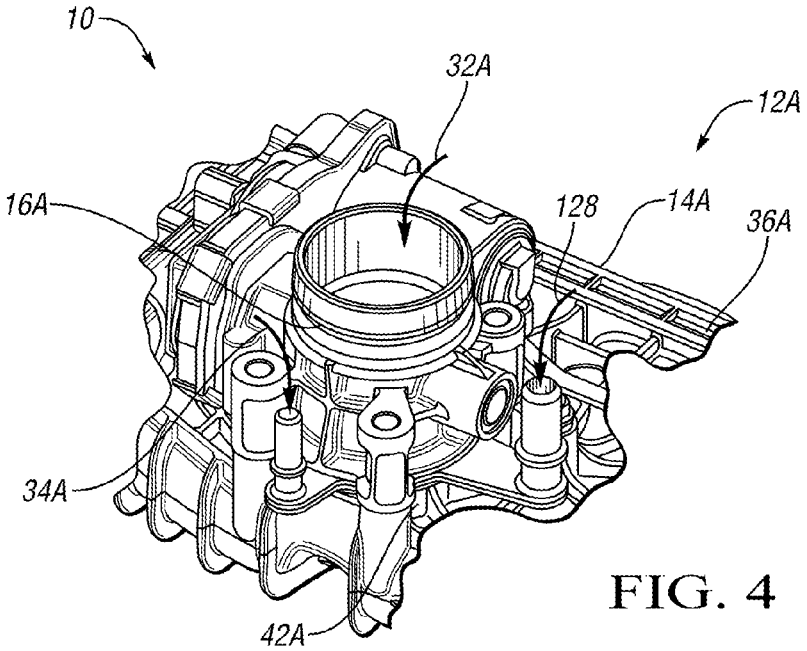
FIG. 4 is a schematic perspective view of a portion of a vehicle including an intake manifold assembly in accordance with an alternative embodiment of the present disclosure, a throttle assembly, and a seal assembly disposed between the throttle assembly and the intake manifold assembly.
Figure 5:
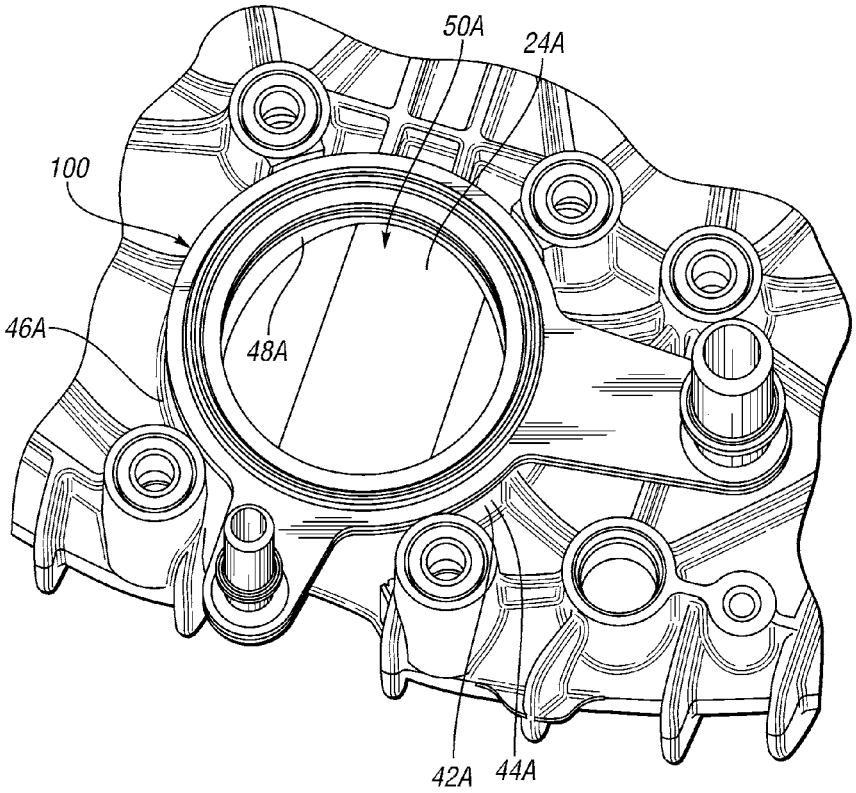
FIG. 5 is a schematic enlarged top view of a portion of the intake manifold assembly and the seal assembly shown in FIG. 4.

With reference to FIGS. 4 and 5, the vehicle 10 may include an alternative device for introducing supplemental gases 34A at a location between a throttle assembly 16A and an interior manifold cavity 24A defined by the intake manifold assembly 14A. In particular, the vehicle 10 includes an internal combustion engine 12A. The internal combustion engine 12A includes an intake manifold assembly 14A configured to deliver intake air 32A to the cylinders (not shown) of the internal combustion engine 12A. In addition, the internal combustion engine 12A includes a throttle assembly 16A coupled to the intake manifold assembly 14A. The throttle assembly 16A is configured to control the amount of intake air 32A that flows into the intake manifold assembly 14A. The throttle assembly 16A may be substantially similar or identical to the throttle assembly 16 shown in FIG. 1.

The intake manifold assembly 14A includes an intake manifold body 36A and a throttle mount 42A coupled to, or monolithically formed with, the intake manifold body 36A. The intake manifold body 36A defines an interior manifold cavity 24A. The throttle mount 42A facilities coupling the throttle assembly 16A to the intake manifold assembly 14A. One or more suitable fasteners may be employed to couple the throttle assembly 16A to the intake manifold assembly 14A as described above with respect to FIG. 1. The throttle mount 42A includes a mount body 44A defining an outer mount surface 46A and an inner mount surface 48A opposite the outer mount surface 46A. The inner mount surface 48A defines a mount passage 50A disposed in fluid communication with the interior manifold cavity 24A defined by the intake manifold body 36A.

The internal combustion engine 12A further includes a supplemental gas distribution device 100 configured to deliver supplemental gases 34A from the supplemental source 58 (FIG. 1) to a location between the throttle assembly 16 and the intake manifold body 36A in order to mix the supplemental gases 34 with the intake air 32 before the mixture enters the cylinders of the internal combustion engine 12A, thereby minimizing cylinder-to-cylinder imbalance. The supplemental gas distribution device 100 is configured to be coupled between the throttle assembly 16A and the intake manifold body 36A. Specifically, the supplemental gas distribution device 100 is configured to be coupled to the throttle mount 42A.

Figure 6:
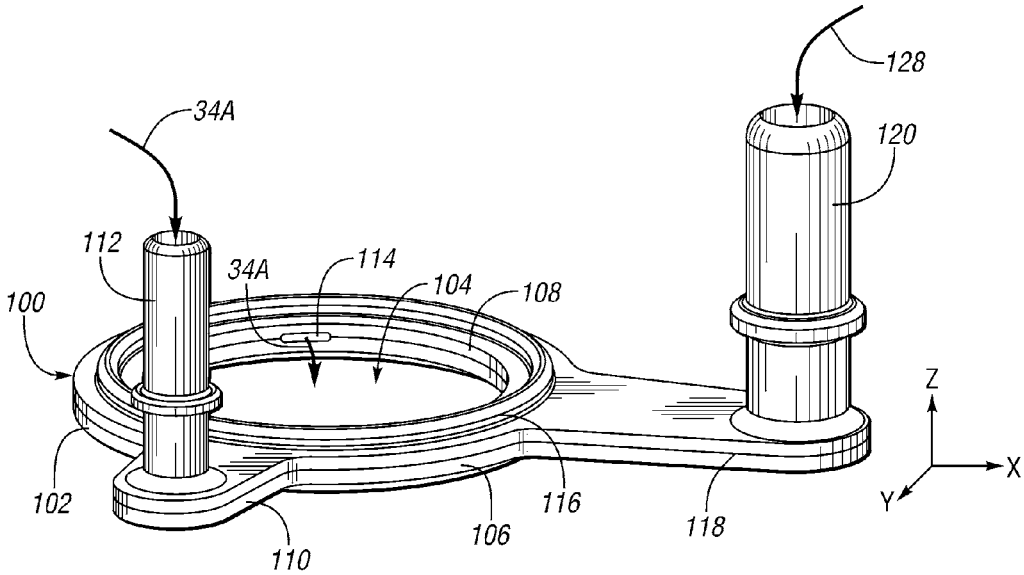
FIG. 6 is a schematic perspective view of the seal assembly shown in FIG. 4.

With reference to FIG. 6, the supplemental gas distribution device 100 includes a device body 102 wholly or partly made of a substantially rigid material such as a hard polymeric material. The device body 102 may have a substantially planar configuration. For example, the device body 102 may be substantially aligned with a plane defined along a first direction, which is indicated by arrow Y, and a second direction, which is indicated by arrow X. The first direction, which is indicated by arrow Y, may be substantially perpendicular to the second direction, which is indicated by arrow X. Moreover, the device body 102 may have a substantially annular shape and defines an outer perimeter surface 106 and an inner perimeter surface 108 opposite the outer perimeter surface 106. The inner perimeter surface 108 defines a device passage 104. Thus, the device body 102 surrounds the device passage 104. The device passage 104 is configured, shaped, and sized to be substantially aligned with the mount passage 50A when the supplemental distribution device 100 is coupled to the throttle mount 42A (see FIG. 5). The device body 102 further defines a plurality of first device openings 114 extending through the inner perimeter surface 108. Alternatively, the device body 102 defines only one first device opening 114. The first device openings 114 fluidly couple the device passage 104 with an interior portion of the supplemental gas distribution device 100 as discussed in detail below. A plurality of first device openings 114 may be arranged annularly along the inner perimeter surface 108.

The supplemental gas distribution device 100 further includes a first device extension 110 protruding from the device body 102 in a direction away from the device passage 104. The first device extension 110 may have a substantially planar configuration. For example, the first device extension 110 may be substantially aligned with a plane defined along the first direction, which is indicated by arrow Y, and the second direction, which is indicated by arrow X. Moreover, the first device extension 110 supports a first port 112 configured to be fluidly coupled to the supplemental gas source 58 (FIG. 1). For example, a tube or any other suitable fluid conduit can fluidly couple the supplemental gas source 58 to the first port 112. The first port 112 is disposed in fluid communication with the first device openings 114. Further, the first port 112 may be elongated along a third direction, which is indicated by arrow Z. The third direction, which is indicated by arrow Z, may be substantially perpendicular to the first direction, which is indicated by arrow Y, and the second direction, which is indicated by arrow X.

The supplemental gas distribution device 100 further includes a second device extension 118 protruding from the device body 102 in a direction away from the device passage 104. The second device extension 118 may have a substantially planar configuration. For example, the second device extension 118 may be substantially aligned with a plane defined along the first direction, which is indicated by arrow Y, and the second direction, which is indicated by arrow X. Moreover, the second device extension 118 may be substantially perpendicular to the first device extension 110 and is configured to support a second port 120. The second port 120 may be elongated along the third direction, which is indicated by arrow Z. Further, the second port 120 is configured to be fluidly coupled to a vacuum servo (not shown) such as a brake booster. A tube or any other suitable fluid conduit can fluidly couple the vacuum servo to the second port 120. The second port 120 is in fluid communication with at least one second device opening 122 (FIG. 8) as discussed in detail below. Thus, gases, such as servo air 128, can flow from the vacuum servo, to the intake manifold assembly 14A via the second port 120. For example, the intake manifold assembly 14A may serve as a vacuum source for the brake booster. As such, gases can flow from the brake booster to the intake manifold assembly 14A via the second port 120.

The supplemental gas distribution device 100 further includes at least one device seal 116 configured to prevent a fluid leak. Accordingly, the device seal 116 may be wholly or partly made of an impermeable material, such as an impermeable polymeric material, and may be a gasket. Moreover, the device seal 116 is coupled to the device body 102. For instance, the device seal 116 may be molded or inserted through the device body 102. In addition, the device seal 116 may have a substantially annular shape and surrounds the device passage 104.

Figure 7:
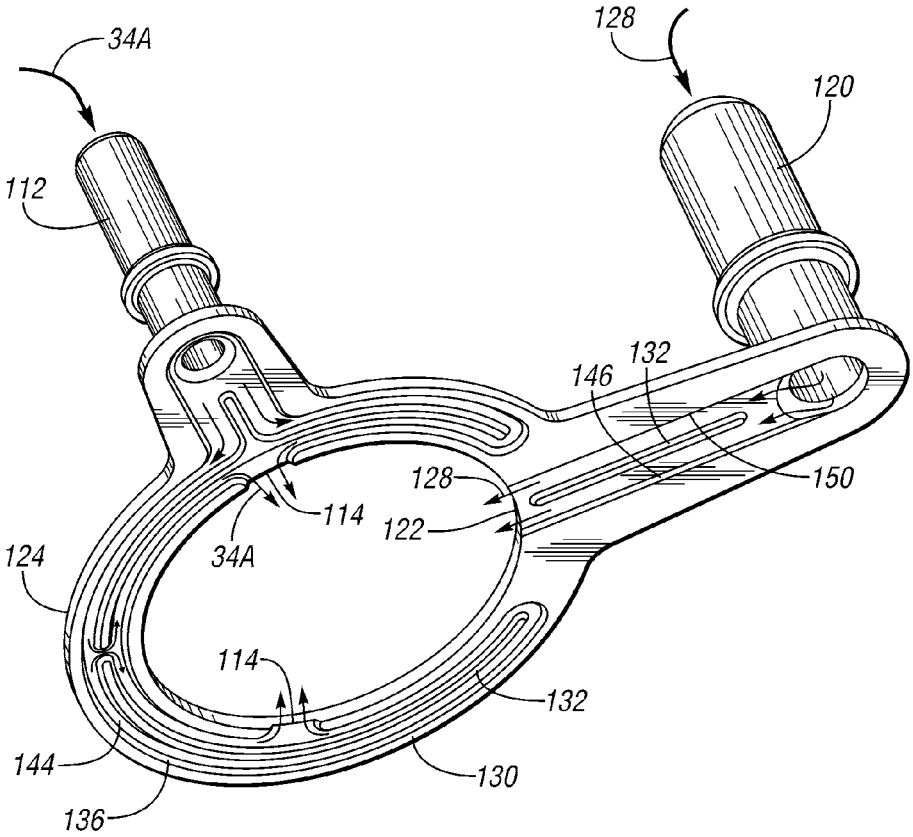
FIG. 7 is a schematic perspective view of a first portion of the seal assembly shown in FIG. 6.
Figure 8:
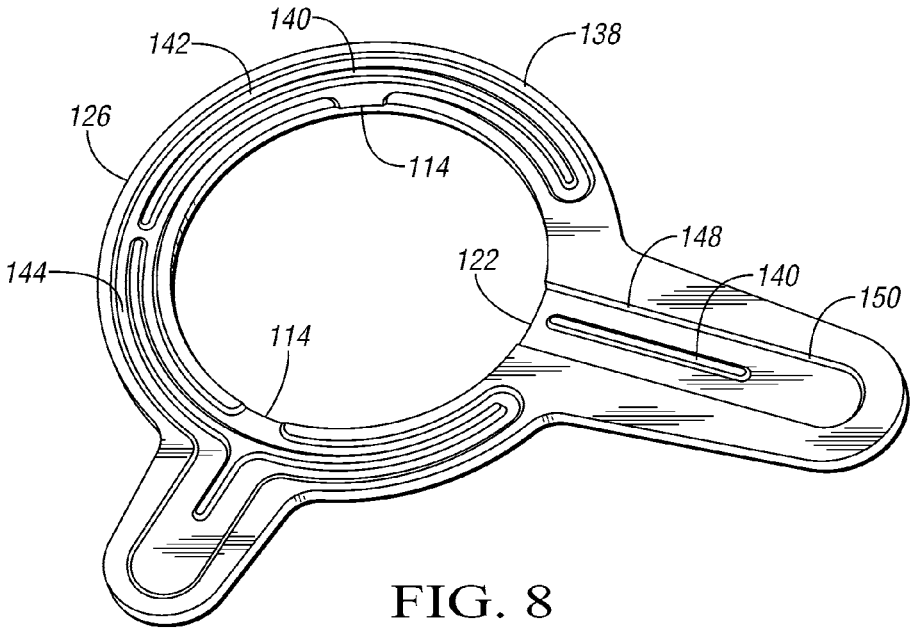
FIG. 8 is a schematic perspective view of a second portion of the seal assembly shown in FIG. 6.

With reference to FIGS. 7 and 8, the supplemental gas distribution device 100 includes a first or upper device portion 124 (FIG. 7) and a second or lower device portion 126 (FIG. 8) configured to be coupled to first device portion 124. The first device portion 124 and the second device portion 126 jointly form the device body 102, the first device extension 110, and the second device extension 118.

The first device portion 124 defines a first interior surface 130 and a plurality of first interior walls 132. The first interior surface 130 and the first interior walls 132 collectively define a first supplemental gas track portion 136. The first supplemental gas track portion 136 is in fluid communication with the first port 112 and the first device openings 114. The first supplemental gas track portion 136 may have a substantially annular shape. The first interior surface 130 and at least one of the first interior walls 132 may define a first vacuum channel portion 146 disposed in fluid communication with the second port 120. The first vacuum channel portion 146 is not in fluid communication with the first supplemental gas track portion 136 or the first port 112.

The second device portion 126 defines a second interior surface 138 and a plurality of second interior walls 140. The second interior surface 138 and the plurality of second interior walls 140 collectively define a second supplemental gas track portion 142. The second supplemental gas track portion 142 may have a substantially annular shape and is in fluid communication with the first port 112 and the first device openings 114. The second interior surface 138 and at least one of the second interior walls 140 defines a second vacuum channel portion 148.

When the first device portion 124 is coupled to the second device portion 126, the first supplemental gas track portion 136 and the second supplemental gas track portion 142 jointly define an interior supplemental gas track 144. The interior supplemental gas track 144 may also be referred to as the supplemental gas groove. Overall, the device body 102 and the first device extension 110 jointly define the interior supplemental gas track 144. The supplemental gas track 144 may be entirely disposed within the device body 102 and the first device extension 110. The supplemental gas track 144 is in fluid communication with the first device openings 114. During operation of the internal combustion engine 12A, the supplemental gases 34A can flow from the supplemental gas source 58 (FIG. 1) into the first port 112. Then, the supplemental gases 34A can flow from the first port 112 into the supplemental gas track 144. Subsequently, the supplemental gases 34A can exit the supplemental gas track 136 via the first device openings 114 and enter the device passage 104. Afterwards, the supplemental gases 34A can be mixed with the intake air 32A and enter the intake manifold body 36A via the mount passage 50A.

When the first device portion 124 is coupled to the second device portion 126, the first vacuum channel portion 146 and the second vacuum channel portion 148 collectively define a vacuum channel 150. The vacuum channel 150 may also be referred to as a vacuum track. Overall, the device body 102 and the second device extension 118 jointly define the vacuum channel 150. Thus, the vacuum channel 150 may be entirely disposed within the device body 102 and the second device extension 118. The vacuum channel 150 is in fluid communication with the second port 120 and the second device opening 122. However, the vacuum channel 150 is not in direct fluid communication with the first port 112. Furthermore, the vacuum channel 150 is not in direct fluid communication with the interior supplemental gas track 144. When a vehicle operator presses a brake pedal of the vehicle 10, servo air 128 flows from the brake booster (not shown) into the second port 120. The servo air 128 then flows into the vacuum channel 150. Subsequently, the servo air 128 exits the vacuum channel 150 via the second device opening 122 and enters the device passage 104. Afterwards, the servo air 128 enters the intake manifold body 36A via the mount passage 50A.

The present disclosure also relates to methods of manufacturing the internal combustion 12A. In an embodiment, the method includes coupling the supplemental gas distribution device 100 to the intake manifold assembly 14A. For example, the device body 102 may be disposed on the throttle mount 42A such that the device passage 50A is in fluid communication with the mount passage 50A and the intake manifold cavity 24A. The first port 112 is fluidly coupled to the supplemental gas source 58 (FIG. 1) using any suitable fluid coupling such as a tube in order to fluidly couple the supplemental gas track 144 to the supplemental gas source 58. The throttle assembly 16A can then be coupled to the supplemental gas distribution device 100 and the intake manifold assembly 14A such that the supplemental gas distribution device 100 is disposed between the throttle assembly 16A and the intake manifold assembly 14A as shown in FIG. 4. For example, any suitable fasteners, such as bolts, may be used to couple the throttle assembly 16A to the intake manifold assembly 14A. At this point, the supplemental gases 34A may be transferred from the supplemental gas source 58 to a location between the throttle assembly 16A and the intake manifold body 36A.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. An intake manifold assembly, comprising:

an intake manifold body defining an interior manifold cavity;

a throttle mount coupled to the intake manifold body and defining a mount passage in fluid communication with the interior manifold cavity, the throttle mount being configured to be coupled to a throttle assembly; and a supplemental gas conduit including a first supplemental gas conduit portion coupled to the intake manifold body, wherein the first supplemental gas conduit portion is configured to be coupled to a supplemental gas source, the first supplemental gas conduit portion is monolithically formed with the intake manifold body, the first supplemental gas conduit portion is not in direct fluid communication with the interior manifold cavity, the supplemental gas conduit further includes a second supplemental gas conduit portion in fluid communication with the first supplemental gas conduit portion, and the second supplemental gas conduit portion is coupled to the throttle mount and is configured to deliver supplemental gases into the mount passage to mix the supplemental gases with intake air flowing through the mount passage.

2. The intake manifold assembly of claim 1, wherein the supplemental gas conduit includes a third supplemental gas conduit portion in fluid communication with the second supplemental gas conduit portion, and the third supplemental gas conduit portion is in fluid communication with the mount passage.

3. The intake manifold assembly of claim 2, wherein the throttle mount defines at least one supplemental gas opening disposed in fluid communication with the third supplemental gas conduit portion, the at least one supplemental gas opening being configured to allow supplemental gas to flow from the third supplemental conduit portion into the mount passage.

4. The intake manifold assembly of claim 2, wherein the third supplemental gas conduit portion has a substantially annular shape.

5. The intake manifold assembly of claim 4, wherein the third supplemental gas conduit portion is disposed within the throttle mount and around the mount passage.

6. The intake manifold assembly of claim 2, wherein the third supplemental gas conduit portion is monolithically formed with the throttle mount.

7. The intake manifold assembly of claim 1, wherein the second supplemental gas conduit portion is monolithically formed with the throttle mount.

8. The intake manifold assembly of claim 2, further comprising a seal assembly coupled to the throttle mount, wherein the seal assembly partially defines the third supplemental gas conduit portion.

9. An intake manifold assembly, comprising:

an intake manifold body defining an interior manifold cavity;

a throttle mount coupled to the intake manifold body and defining a mount passage in fluid communication with the interior manifold cavity, wherein the throttle mount is configured to be coupled to a throttle assembly;

a supplemental gas conduit, wherein the supplemental gas conduit includes:

a first supplemental gas conduit portion coupled to the intake manifold body, wherein the first supplemental gas conduit portion is configured to be coupled to a supplemental gas source;

a second supplemental gas conduit portion in fluid communication with the first supplemental gas conduit portion, wherein the second supplemental gas conduit portion is coupled to the throttle mount;

a third supplemental gas conduit portion in fluid communication with the second fluid conduit, wherein the third supplemental gas conduit portion is in fluid communication with the mount passage and is configured to deliver supplemental gases into the mount passage to mix the supplemental gases with intake air flowing through the mount passage; and a seal assembly coupled to the throttle mount, wherein the seal assembly partially defines the third supplemental gas conduit portion.

10. The intake manifold assembly of claim 9, wherein the throttle mount defines at least one supplemental gas opening disposed in fluid communication with the third supplemental gas conduit portion, the at least one supplemental gas opening being configured to allow supplemental gas to flow from the third supplemental conduit portion into the mount passage.

11. The intake manifold assembly of claim 9, wherein the third supplemental gas conduit portion has a substantially annular shape.

12. The intake manifold assembly of claim 9, wherein the third supplemental gas conduit portion is disposed within the throttle mount and surrounds the mount passage.

13. The intake manifold assembly of claim 9, wherein the first supplemental gas conduit portion is monolithically formed with the intake manifold body.

14. An intake manifold assembly, comprising:

an intake manifold body defining an interior manifold cavity;

a throttle mount coupled to the intake manifold body and defining a mount passage in fluid communication with the interior manifold cavity, wherein the throttle mount is configured to be coupled to a throttle assembly;

a supplemental gas conduit coupled to the intake manifold body and being configured to be coupled to a supplemental gas source, wherein the supplemental gas conduit is in fluid communication with the mount passage and includes a first supplemental gas conduit portion that is not in direct fluid communication with the interior manifold cavity;

a seal assembly coupled to the throttle mount, wherein the seal assembly partially defines the supplemental gas conduit; and wherein the supplemental gas conduit is configured to deliver supplemental gases into the mount passage to mix the supplemental gases with intake air flowing through the mount passage.

15. The intake manifold assembly of claim 14, wherein a portion of the supplemental gas conduit surrounds the mount passage.

16. The intake manifold assembly of claim 14, wherein the supplemental gas conduit includes a second supplemental gas conduit portion in fluid communication with the first supplemental gas conduit portion, and the second supplemental gas conduit is monolithically formed with the throttle mount.

17. The intake manifold assembly of claim 16, wherein the supplemental gas conduit includes a third supplemental gas conduit portion in fluid communication with the second fluid supplemental gas conduit portion, and the third supplemental gas conduit portion is in direct fluid communication with the mount passage.

18. The intake manifold assembly of claim 17, wherein the third supplemental gas conduit portion has a substantially annular shape so as to surround the mount passage.

19. The intake manifold assembly of claim 17, wherein the seal assembly partially defines the third supplemental gas conduit portion.

* * * * *